US006503161B2

(12) United States Patent
Bothwell

(10) Patent No.: US 6,503,161 B2
(45) **Date of Patent: *Jan. 7, 2003**

(54) GAME RACKET INCLUDING A STRING SUSPENSION SYSTEM

(76) Inventor: Brett Peter Bothwell, 101 W. 75th St., #3B, New York, NY (US) 10023-1812

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/248,536

(22) Filed: Feb. 11, 1999

(65) Prior Publication Data

US 2002/0039937 A1 Apr. 4, 2002

(51) Int. Cl.[7] ..... A63B 49/00

(52) U.S. Cl. ..... 473/540; 473/521; 473/522; 473/539

(58) Field of Search ..... 473/539, 540, 473/534, 520, 521, 522

(56) References Cited

U.S. PATENT DOCUMENTS

| | | | | | |
|---|---|---|---|---|---|
| 1,558,507 | A | | 10/1925 | Ryder | |
| 3,884,467 | A | * | 5/1975 | Sommer | 473/539 |
| 3,999,756 | A | | 12/1976 | Head | |
| 4,005,862 | A | | 2/1977 | Portz et al. | |
| 4,165,071 | A | | 8/1979 | Frolow | |
| 4,613,138 | A | | 9/1986 | Haythornwaite | |
| 4,765,620 | A | | 8/1988 | Janes | |
| 4,772,021 | A | | 9/1988 | Maynard | |
| 5,141,228 | A | * | 8/1992 | Soong | 473/521 |
| 5,165,687 | A | * | 11/1992 | Soong | 473/521 |
| 5,197,732 | A | | 3/1993 | Lanctot | |
| 5,332,213 | A | | 7/1994 | Klose | |
| 5,368,297 | A | * | 11/1994 | Liu | 473/539 |
| 5,419,963 | A | | 5/1995 | Kueber | |
| 5,458,331 | A | | 10/1995 | Bothwell | |
| 5,538,243 | A | | 7/1996 | Yamamoto et al. | |
| 5,613,916 | A | | 3/1997 | Sommer | |
| 5,762,570 | A | * | 6/1998 | Shaw | 473/522 |
| 5,944,625 | A | * | 8/1999 | Janes | 473/539 X |

FOREIGN PATENT DOCUMENTS

| | | | | |
|---|---|---|---|---|
| DE | 2611970 | * | 9/1977 | 473/FOR 178 |
| DE | 2225595 | * | 3/1980 | 473/FOR 178 |
| DE | 3740765 | | 6/1989 | |
| EP | 060170 | | 1/1994 | |
| EP | 0803271 | | 10/1997 | |
| FR | 1059989 | * | 11/1953 | 473/FOR 178 |
| FR | 2587227 | * | 3/1987 | 473/FOR 178 |
| WO | 9847574 | | 10/1998 | |

* cited by examiner

*Primary Examiner*—Raleigh W. Chiu
(74) *Attorney, Agent, or Firm*—Kenyon & Kenyon

(57) ABSTRACT

A racket includes a frame, at least one string and a particular portion The frame includes a handle portion and a head portion. The string is connected to the frame to provide a string tension. The particular portion is composed of a non-fluid material and disposed on the frame. The particular portion cooperates with the at least one string and is designed to reduce the string tension of the string upon a deflection of the string. The particular portion compresses when the string tension of the at least one string increases.

7 Claims, 4 Drawing Sheets

GAME RACKET INCLUDING A STRING SUSPENSION SYSTEM

FIELD OF THE INVENTION

The present invention relates to a game racket, in particular to a racket having a string suspension system.

BACKGROUND INFORMATION

Contemporary game rackets such as those used for playing tennis, typically are made of lightweight high strength composite materials such as graphite, super graphite, and titanium to name a few. Some of the most advanced rackets are as light as seven ounces. The superior strength to weight ratio of these space age materials has made it possible to enhance the hitting quality of rackets significantly.

Rackets today have larger "sweet spots".In other words, the area of optimum response on the stringed surface is larger than those used previously. Contemporary rackets have been made stiffer and more powerful than ever before. Power has been increased further by making the rackets bigger and longer and yet they remain lighter than ever. Unwanted vibration and shock common to typical racket construction, is being dampened and attenuated by a number of partially successful means.

Yet in spite of the many improvements offered by innovations over the years, a vast majority have been limited by the inherent nature of the standard stringing system. As defined in Bothwell—U.S. Pat. No. 5,458,331 a major drawback common to previous racket improvements is a "fixed node" stringing system. In the fixed node system the string is laced and/or secured directly to the frame and is partially responsible for the limited size of the sweet spot and the lack of rebound near the edges of the stringed surface. The fixed node configuration is also responsible for direct transfer from the string to the frame of undesirable vibrations and shock from ball impact. Consequently, any attempt to enhance the sweet spot or to improve shock attenuation in a conventional racket is limited by the nature of this stringing system. Fixed node stringing has remained primarily an assumed standard in the history of racket design and construction.

Many reasonable improvements of the fixed node type racket can be found. In U.S. Pat. No. 3,999,756 (by Head) the area of the optimum response on the strings simply is increased by making the stringed surface itself bigger. In U.S. Pat. No. 4,165,071 Frolow improves the sweet spot by modifying the balance and swing weight of the frame. Both however are of the fixed node type and are limited in scope as such.

In U.S. Pat. No. 5,332,213, Klose increases the maximum elastic response of the stringed surface with enlarged string holes which permit the string to move more freely about its fixed node. In U.S. Pat. No. 5,419,963, Kuebler describes a string with a gradually decreasing diameter from its fixed node at the frame to the center of the stringed surface. The thinner middle portion of the string increases its maximum elastic length to improve the sweet spot.

Since the abandonment of wood rackets, shock attenuation has been a major issue in racket design. An inherent inability of graphite composites to attenuate shock in contemporary rackets is aggravated by both the "eggshell" like construction of the new super light frames and the ill effects of fixed node stringing. The hitting quality is akin to something made of tin. In fact most rackets currently under 9 ounces have vibration damping handle designs to dampen shock and to add a solid feel to the hollow hitting quality.

Although most shock attenuation methods rely on a post reaction approach, whereby impact shock in the frame is assumed to be a pre-existing condition, there are some that have relied on a pre-reaction approach. A pre-reaction approach does not assume that shock is a pre-existing condition. It attempt to attenuate shock prior to its transfer from the striking surface to the frame.

An early example of this is illustrated by Ryder—U.S. Pat. No. 1,558,507. The stringed surface of the Ryder racket is attached directly to a pneumatic tube which defines its perimeter about the head. By joining the strings with the tube, isolation of the stringed surface from the frame is achieved. Ryder proposes to enhance the liveliness of the strings by securing the tube to the frame with springs. By today's design standards, the racket of Ryder is inefficient and its array of fittings is complicated and difficult to employ practically.

Another pre-reaction method of shock attenuation and performance enhancement is described in Haythornwaite—U.S. Pat. No. 4,613,138 where a ductile connection between the string and frame is provided by a flexible membrane. As in Ryder, the strings are attached to the membrane with mechanical loops. Manipulation of the tensile state of the membrane, alters its "spring energy" and therefore its elastic response and that of the strings. Though the idea is sound the achievement is marred by the mechanical spring assembly located in its handle and the difficulty of its integration with existing racket conventions and methods of fabrication.

Another effort to improve upon fixed node stringing with a pre-reaction approach to racket performance enhancement exists in the form of Maynard—U.S. Pat. No. 4,772,021. Maynard provides a ductile connection of the entire string-bed to the head by means of an inflatable rubber tube. The isolated string-bed offers dramatically reduced shock transfer and improved response of the stringed surface. Its inner frame of the fixed node type however, requires a redundant structure, making the racket heavy, unwieldy and difficult to integrate with current racket conventions. An approach similar to Maynard is Lanctot—U.S. Pat. No. 5,197,732 in which a stringed hoop of the fixed node type is isolated from the frame and held in place by a fluid matter. Some of the best qualities of string isolation are attained, but the redundant structure and the density of the fluid matter required make the racket too heavy.

A most effective pre-reaction solution to fixed node stringing is described by Bothwell—U.S. Pat. No. 5,458,331 in which the woven string-bed of the racket is isolated from the frame by air cushions and is referred to as suspended node stringing. The redundant structure of Maynard is avoided in Bothwell by allowing the tensile load of the string loop carriers to bear on outer facing surface of the cushions. The ductile connection of the strings and frame afforded by the suspension system of Bothwell, improves the area and responsiveness of the sweet spot. Suspended node stringing is unique in its ability to be adapted to accepted racket conventions and methods of manufacture. It represents a fully integrated attenuation method that isolates impact shock at the string bearing point before its transfer to the frame.

The preferred embodiment of this suspension system for a game racket offers most of the performance enhancements of U.S. Pat. No. 5,458,331 but in a simplified manner that is easier to produce. In this version, an isolating gasket is used to isolate the stringed surface from the frame. The resulting string suspension system has all of the qualities of suspended node stringing as defined by Bothwell, but without the inherent difficulty of a fluid tight system.

The ductile connection of the string to the frame in the present invention results in an increase in area of the sweet spot. The degree of enhanced string responsiveness is a function of the physical characteristics of the isolating matter. A compressible matter will decrease the rebound differential from the strings midpoint to its end, making the string more responsive nearer the edge of the stringed surface. In the suspended node configuration, the resiliency of the isolating matter serves to propel the ball with accelerating velocity as it leaves the strings and the compressibility of the matter determines the degree of improved elastic response and dwell time of the ball on the strings. This ability of the suspension system to provide "hold" on the ball, is a dramatic improvement over the playing quality of a typical racket.

By isolating the string from the frame with a lightweight isolating matter, shock attenuation occurs between the string and frame immediately adjacent to the impact area. The transfer of impact shock to the primary frame is dramatically reduced depending in part on the energy absorbing characteristics of the isolating material. The dampening action of the gasket adds solidity and substance to the hitting quality of the lightest frames. A shock attenuator in the handle or laced through the strings is no longer necessary.

In suspended node stringing, the hitting quality of a racket can be modified by changing the physical properties of the isolating matter. Manipulating the volume and pressure of an air gasket as described by U.S. Pat. No. 5,458,331 will change the hitting quality of a racket. The hitting quality of the racket in the present invention can be controlled by the degree of compressibility or resiliency of the isolating matter. A high density, high impact resistant material would provide a more solid, firmer feel on the ball than the softer feel that a lower density, more compressible substance would give. Other types of materials would likely produce a variety of hitting qualities. An ability to modify the playing quality of a racket by changing the gasket provides a desirable flexibility that recreational players and professionals alike will appreciate.

There can be no doubt about the positive effects of suspended node stringing. The ability to flexibly connect the string and frame coupled with the capacity to precisely control that ductility in a fully integrated approach is a major step in the evolution of string isolation in racket design. That the technology is here represented in a manner that simplifies its construction is a significant step in its path to manufacture.

Accordingly, it is an object of the present invention to provide a game racket with an improved performance.

Another object of the present invention is to provide a particular (e.g., ductile) connection between the string and the frame. It is another object of the present invention to employ a suspended node stringing arrangement, e.g., in a mass produced manner.

A further object of the present invention is to improve a rebound towards a perimeter of the stringed surface and thus to expand the sweet spot. Another object of the present invention is to attenuate an impact shock and a vibration before its transfer from the string to the frame.

Another object of the present invention to isolate and insulate the stringed surface within the head of a racket. A still further object of the present invention is to provide a string suspension system utilizing, e.g., a pressure resistant lightweight isolating material such as foam, silicone, gel, elastomeric chord, etc.

According to the present invention, a racket includes a frame, at least one string and a particular portion. The frame includes a handle portion and a head portion. The string is connected to the frame to provide a string tension. The particular portion is composed of a non-fluid material and disposed on the frame. The particular portion cooperates with the at least one string and is designed to reduce the string tension of the string upon a deflection of the string. The particular portion compresses when the string tension of the at least one string increases.

DETAILED DESCRIPTION

According to a preferred embodiment of the present invention, the components may be lightweight and durable and can be composed of materials known to those having ordinary skill in the art. These materials may be constructed using conventional methods in the game racket industry (e.g., a high temperature injection molding).

Figure 1A:
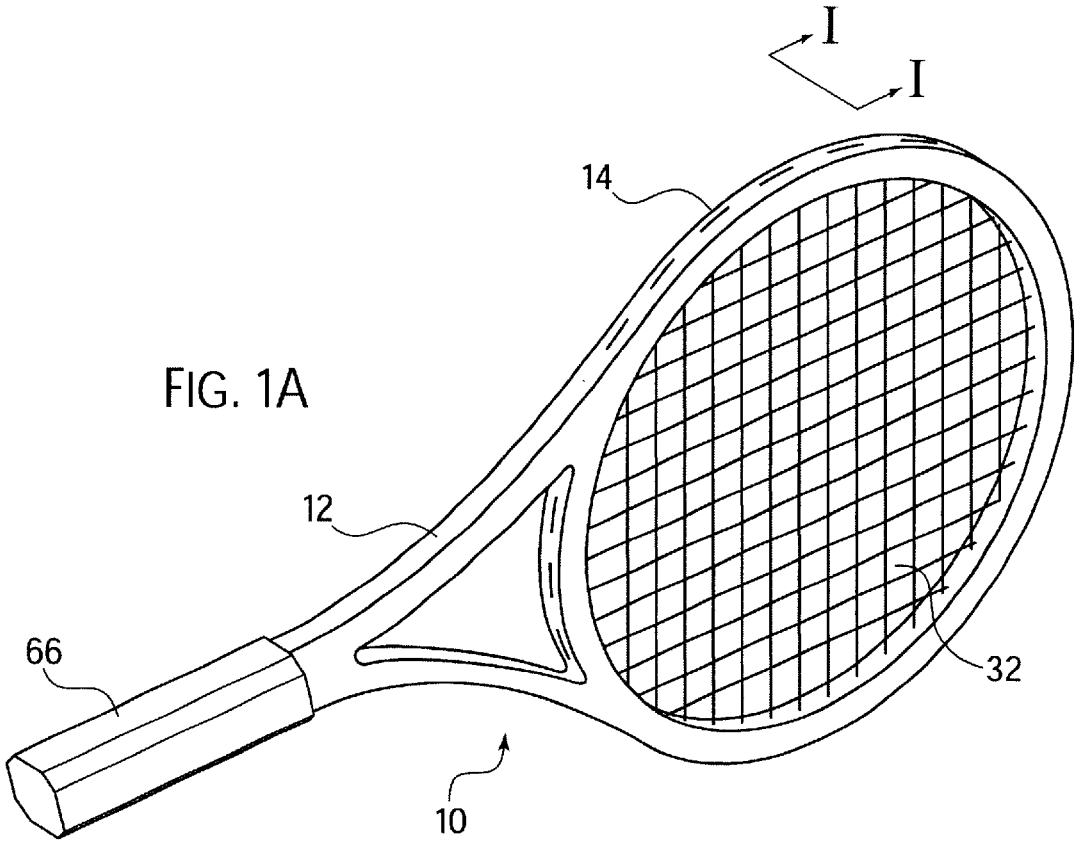
FIG. 1A shows a perspective view of a racket according to the present invention.
Figure 1B:
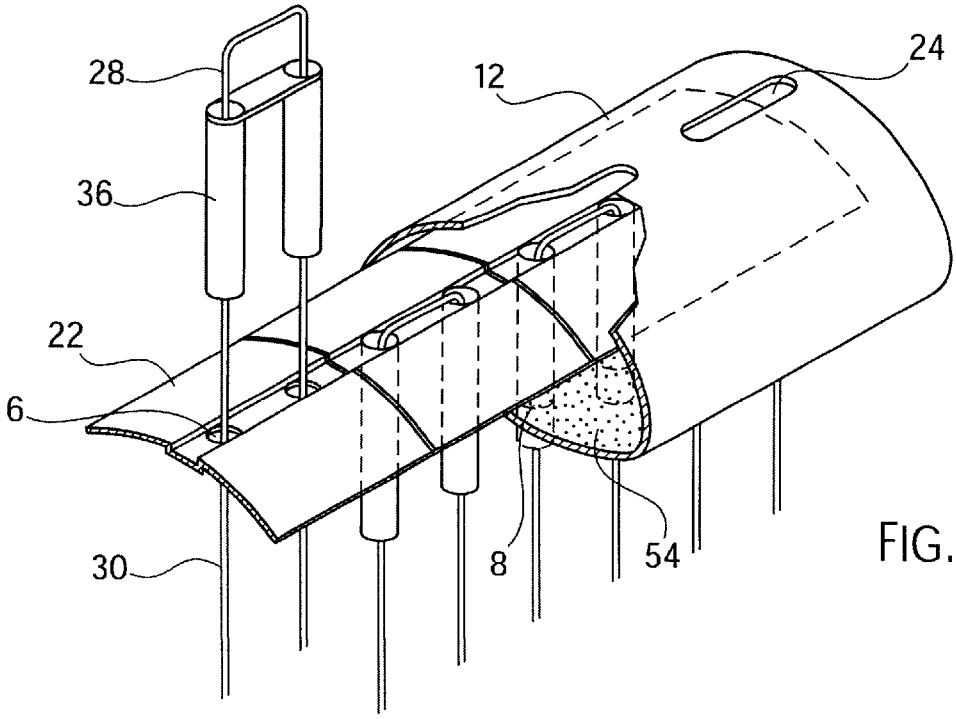
FIG. 1B shows a perspective sectional view along line 1-1 in FIG. 1A, of a first embodiment of a string suspension system.

FIGS. 1A and 1B show a first embodiment of a string suspension system for a game racket according to the present invention. In particular, FIG. 1A illustrates a racket 10 including a primary frame 12, a head portion 14 and a handle 66. FIG. 1B illustrates a three dimensional cross-section 1-1 through the head portion 14 of the primary frame 12. A suspension frame 22 (or a plurality of suspension frames) is provided within the hollow cavity of the head portion 14. The suspension frame 22 conforms to an outer circumference of the head portion 14. A grommet 36 engages with the suspension frame 22 through holes 6 in a central spine portion of the suspension frame 22. Holes 8 in a resisting surface of the primary frame 12 are aligned with the holes 6 of the suspension frame 22 and slotted openings 24 in the primary frame 12. Thus, the grommet 36 is inserted through the holes 6 of the suspension frame 22 and through the holes 8 of the primary frame 12 to be slidably engaged with the primary frame 12. A string loop 28 of a string 30 is laced through the grommet 36 and thus secured to the suspension frame 22. The string loop 28 is capable of moving freely with respect to the primary frame 12 and in unison with the suspension frame(s) 22. An isolating matter 54 (e.g., a foam material, a rubber material, etc.) is located between the suspension frame 22 and the resisting surface of the primary frame 12. In this manner, the string loop 28 is isolated from the primary frame 12. The isolating matter 54 can also be on a particular side of the primary frame 12 facing a center of the racket 10. Other configurations of the isolating matter 54 with respect to the suspension frame 22 and the primary frame 12 are also possible. For example, the isolating matter 54 may enclose either the suspension frame 22, the primary frame 12, or both.

Figure 2A:
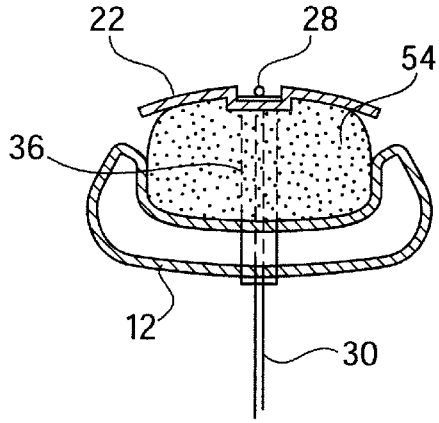
FIG. 2A shows a cross-sectional view along line 1-1 in FIG. 1A, of a second embodiment of the string suspension system in a first position (e.g., no external influences acting thereon).
Figure 2B:
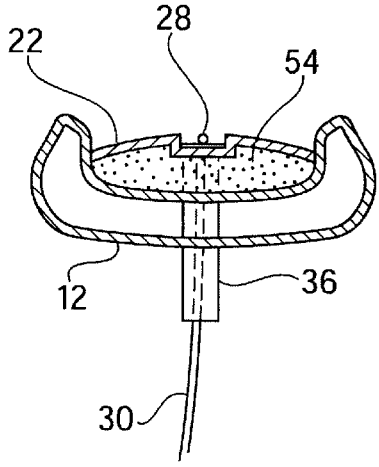
FIG. 2B shows a cross-sectional view of the second embodiment of the string suspension system in a second position (e.g., a string tension increase due to an external influence—contact with a ball).
Figure 2C:
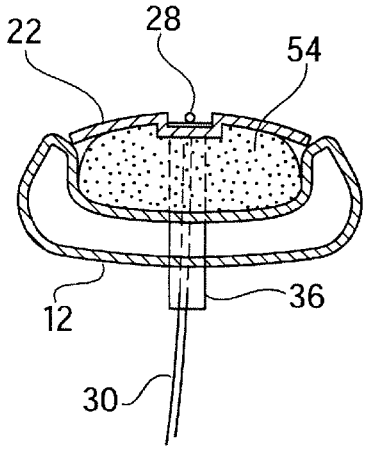
FIG. 2C shows a cross-sectional view of the second embodiment of the string suspension system in a third position (e.g., the string tension returning to the first position as the ball releases from the string).

FIGS. 2A, 2B, and 2C show a cross-section of a second embodiment of the string suspension system according to the present invention. The string loop 28 is tension laced through the primary frame 12, the isolating matter 54 and the suspension frame 22. The isolating matter 54 is disposed in an external channel of the frame 12 (which faces away from the resisting surface of the primary frame 12) and resists a tensile force of the string 30. FIG. 2A shows the isolating matter 54 resisting a normal string tension (e.g., when no external pressure is applied on the string 30). FIG. 2B shows the isolating matter 54 being further compressed with an increased string tension caused by, e.g., an impact of a ball. Such compressive reaction results in an increased elastic response and an additional dwell time of the ball on the string 30. As shown in FIG. 2C, if a flexible resilient matter is used for the isolating matter 54, a "spring energy" of the isolating matter 54 causes an accelerated return of the suspension frame 22 to its normal position (shown in FIG. 2A) as the ball leaves the string 30. Such resilient reaction provides an accelerated release of the ball.

In operation, the string suspension system is initially provided in a predetermined state as shown in FIG. 2A. For example, the string 30 is tensed by compressing the isolating matter 54 in a predetermined manner. When the isolating material 54 is compressed by pre-tensing the string 30, the isolating matter 54 produces a first force (e.g., a first pressure) which is directed away from a center of the racket 10. Because of the cooperation of the isolating matter 54 and the string 30, and because of the compression of the isolating matter 54, the string 30 generates a second force (e.g., a second pressure) directed toward the center of the racket 10. The first and second forces are equal and opposite. As such, the first and second forces counteract one another. When the ball strikes the string 30 (e.g., see FIG. 2A), the second force generated by the string 30 is increased, the isolating mass 54 is therefore compressed and the first force is increased. When the string 30 deflects the ball (e.g., the ball leaves the string 30 of the racket 10), the second force generated by the string 30 is decreased. Accordingly, the compression of the isolating mass 54 is reduced (see FIG. 2C), and thus the first force generated by the isolating mass 54 is also reduced.

Figure 3:
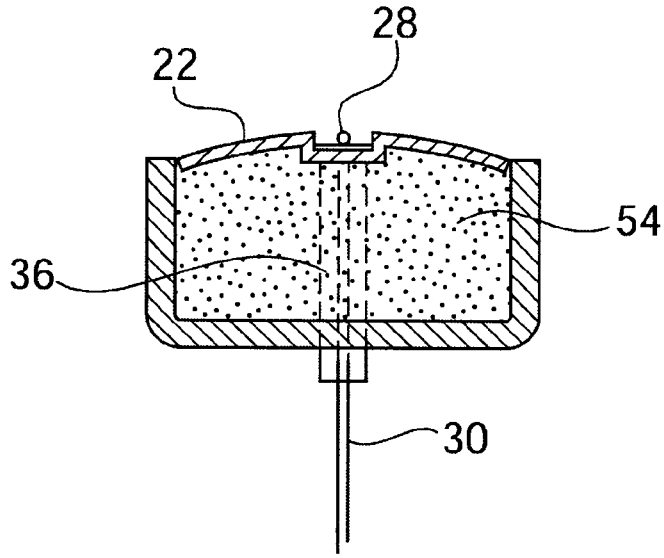
FIG. 3 shows a cross-sectional view along line 1-1 in FIG. 1A, of a third embodiment of the string suspension system according to the present invention.

A cross-section of a third embodiment of the string suspension system according to the present invention is shown in FIG. 3. The primary frame 12 is shown as a U-shape frame composed of a high strength material (e.g., a graphite composite, an alloy, stainless steel or the like). The isolating matter 54 is disposed in the channel of the U-shaped primary frame 12. The isolating matter 54 resists a bearing pressure (e.g., the second force) of the string loop 28 of the string 30 on the suspension frame 22. A suspension frame 22 is slidably engaged within the primary frame 12. For example, the suspension frame 22 is provided over the isolating mass 54. The string 30 is laced through the isolating matter 54, the suspension frame 22 and the primary frame 12 in a similar manner as described above with reference to FIGS. 1A and 1B.

Figure 4:
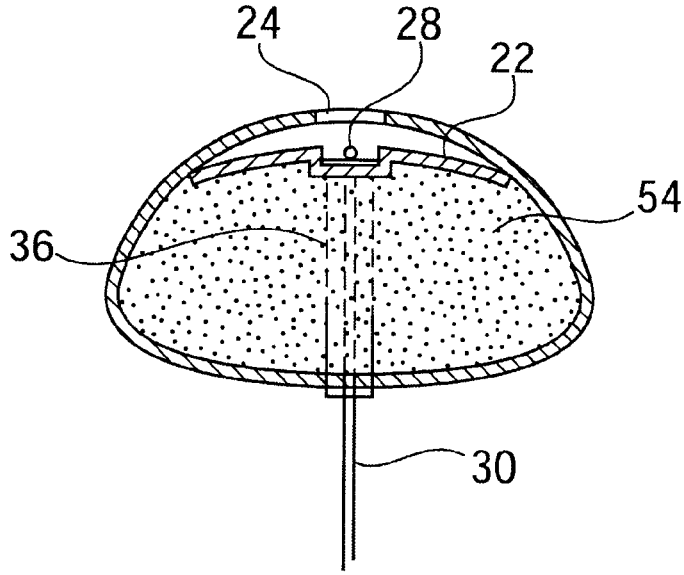
FIG. 4 shows a cross-sectional view along line 1-1 in FIG. 1A, of the internal embodiment shown in FIG. 1A of the string suspension system according to the present invention.

FIG. 4 shows another cross-section of the first embodiment of the string suspension system illustrated in FIG. 1B. The slotted openings 24 in the primary frame 12 on an outer periphery of the head portion 14. The slotted openings 24 allow the string loop 28 to provide pressure on the suspension frame 22 (which is disposed inside the hollow cavity of the primary frame 12). The slotted openings 24 allow the string 30 to be laced through the primary frame 12 similarly to the manner in which the strings are stringed in a conventional racket.

Figure 5A:
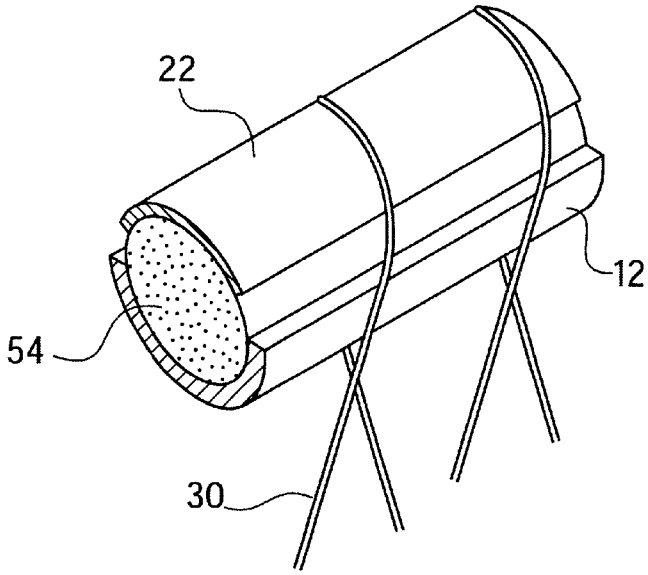
FIG. 5A shows a perspective cross-sectional view along line 1-1 in FIG. 1A, of a fifth embodiment of the string suspension system according to the present invention.
Figure 5B:
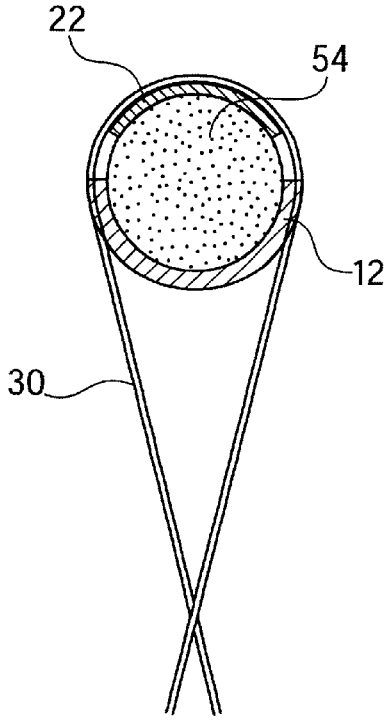
FIG. 5B shows a cross-sectional view of the fifth embodiment of the string suspension system.

FIG. 5A shows a fifth embodiment of the string suspension system according to the present invention. In particular, the isolating matter 54 is disposed in a U-shape surface (facing away from the center of the stringed surface 32) of the primary frame 12. The string 30 wraps around the primary frame 12 and bears on an outer surface (which faces away from the center of the stringed surface 32) of the isolating matter 54. In this embodiment, the string 30 also wraps around an outer surface (which faces away from the center of the stringed surface 32) of the suspension frame 22. The suspension frame(s) 22 distributes a bearing pressure (e.g., the string pressure) to the isolating matter 64. In another embodiment of the present invention, the string 30 is disposed directly on the outer surface of the s isolating matter 54 to provide the bearing pressure directly thereon. FIG. 5A illustrates how the string suspension system is constructed without piercing the isolating matter 54. FIG. 5B shows a cross-sectional view of the string suspension system. The suspension frame 22 is provided between the string 30 and the isolating matter 54 to evenly distribute the bearing pressure.

It is preferable for the suspension system to encircle the entire stringed surface thereby isolating every string. In another embodiment, isolation of the strings may be compartmentalized to affect only certain strings or string groups.

In another embodiment of the present invention, the suspension system provides the isolating matter 54 and the suspension frame 22 (or a plurality of frames) together in a flexible strip that can be inserted as an integral unit into the racket 10 before molding. In yet another embodiment of the present invention, the suspension system only binds the suspension frames 22 together in a flexible strip and provides the isolating matter 54 separately therefrom. One of the advantages of such internal application of the suspension system is its ability to dispose the isolating matter 54 to contain pressure.

The partially integrated external embodiment according to the present invention would not require an implantation of the suspension frame(s) prior to molding the racket. An external placement of the suspension frame(s) about a periphery of the head portion 14 would allow the isolating matter 54 to be easily replaced by a user (e.g., a player). Various compositions of the isolating matter 54 provide different striking characteristics, therefore adding a desirable flexibility to the racket.

In another embodiment of the present invention, the suspension system utilizes a ribbon-type elastomeric spring either together with the isolating matter 54 or instead of the isolating matter 54. In yet another embodiment, the isolating matter 54 may be an elastomeric chord. In another embodiment of the present invention, internal and external suspension systems can be combined.

The string suspension system of the present invention can be adaptable to any size or shape of the racket 10. The suspended node configuration of the suspension system enhances a feel of elastic and durable synthetic strings, and provides a potential to improve upon the bite and grab of a gut string or to replicate the elastic response of gut with a synthetic.

The string suspension system of the present invention offers the benefits of suspended node technology defined in U.S. Pat. No. 5,458,331 in a simpler manner. The suspension system according to the present invention improves rebound of the string near the edge of the frame, enlarges the sweet spot and dramatically increases the dwell time of the ball on the strings. The isolated string-bed provides impact shock attenuation that is vastly improved over a conventional racket with a fixed node string configuration.

Although the foregoing invention has been described in terms of certain preferred embodiments, other preferred embodiments will become apparent to those of ordinary skill in the art in view of the disclosure herein. Accordingly, the present invention is not intended to be limited by the recitation of preferred embodiments, but is intended to be defined solely by reference to the appended claims.

| REFERENCE NUMERALS | |
|---|---|
| 6 | holes in primary frame |
| 8 | holes in suspension frame |
| 10 | racket |
| 12 | primary frame |
| 14 | head |
| 22 | suspension frame(s) |
| 24 | slotted openings in primary frame |
| 28 | string loop |
| 30 | string |
| 32 | stringed surface |
| 36 | grommet |
| 54 | isolating matter |
| 66 | handle |

What is claimed is:

1. A racket, comprising:

a) a U-shaped primary frame defining a U-shaped channel including a handle member and a head member;

b) at least one string connected to the frame to provide spring tension;

c) a suspension frame slidably engaged within the U-shaped channel of the primary frame; and d) an isolating portion composed of a non-fluid material, the isolating portion disposed in the U-shaped channel between the primary frame and the suspension frame, the portion cooperating with the at least one string to reduce the string tension of the at least one string upon a deflection of the at least one string, wherein the portion compresses when the string tension of the at least one string increases and wherein the string is laced through the isolating portion, the string is laced through the suspension frame, and the string is laced through the primary frame, wherein the portion is a non-helical portion.

2. The racket according to claim 1, wherein, when the string tension is increased, the portion compresses to reduce the string tension and to generate a resistance force, the resistance force counteracting the string tension force.

3. The racket according to claim 1, wherein the portion is composed of a substantially solid material.

4. The racket according to claim 1, wherein the portion has a predetermined shape in an uncompressed state.

5. The racket according to claim 1, wherein the portion is composed of a foam material.

6. The racket according to claim 1, wherein the head member has at least one first through-hole and the portion has at least one second through-hole, and wherein the at least one string extends through the first and second through-holes.

7. The racket according to claim 1, wherein the portion is composed of an energy absorbing material.

* * * * *